US005294160A

United States Patent [19]

Arthur

[11] Patent Number: 5,294,160

[45] Date of Patent: Mar. 15, 1994

[54] SECURITY DEVICE FOR DUAL DOORS

[76] Inventor: Robert H. Arthur, 1665 Via Estrella, Pomona, Calif. 91768

[21] Appl. No.: 92,507

[22] Filed: Jul. 15, 1993

[51] Int. Cl.[5] ..... E05C 19/18

[52] U.S. Cl. ..... 292/258; 292/288; 70/DIG. 65

[58] Field of Search ..... 70/DIG. 65; 292/106, 292/258, 288, 302, DIG. 21

[56] References Cited

U.S. PATENT DOCUMENTS

| | | | |
|---|---|---|---|
| 694,975 | 3/1902 | Marshall | 292/262 |
| 2,151,587 | 3/1939 | Cassileth | 292/288 |
| 2,331,150 | 10/1943 | Whiting, Jr. | 292/288 |
| 2,532,586 | 12/1950 | Wickwire | 292/288 |
| 2,663,585 | 12/1953 | Tye | 292/106 |
| 2,789,849 | 4/1957 | Hughes | 292/302 X |
| 2,899,229 | 8/1959 | Jenks | 292/288 |
| 3,059,952 | 10/1962 | Witman et al. | 292/288 |
| 3,383,130 | 5/1968 | De Avila | 292/92 |
| 4,082,334 | 4/1978 | Volta et al. | 292/288 |
| 4,955,648 | 9/1990 | Miller | 292/288 X |
| 5,143,413 | 9/1992 | Vandenhoek | 292/302 |

*Primary Examiner*—Richard E. Moore

*Attorney, Agent, or Firm*—Denton L. Anderson

[57] ABSTRACT

A security device for securing first and second adjacent doors having first and second door knobs, respectively. Each door knob has a neck portion and a head portion. The security device comprises: (a) a rigid plate disposed substantially between two parallel planes; (b) first and second openings spaced apart from one another in a bottom wall of the plate; (c) first and second holes in first and second side walls of the plate, the holes extending through the plate into the openings; and (d) first and second locking pins slidably disposed within the first and second holes. The first and second locking pins extend below the respective neck portions of the door knobs when the locking pins are in their locking positions. The locking pins have protruding portions extending out of the side walls of the plate for gripping by a user of the security device. A ball can be provided near an inner end of each locking pin. The ball has a diameter larger than the diameter of the respective hole in which the respective locking pin slides to prevent the locking pin from being removed from the plate. A notch can also be provided in inside walls of the openings. The balls rest in the notches when the locking pins are in their locking positions.

14 Claims, 1 Drawing Sheet

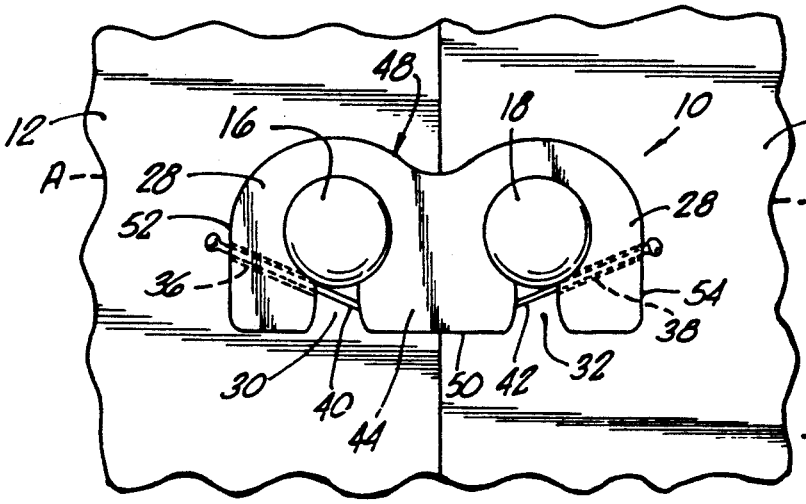
FIG. 1.
FIG. 2.
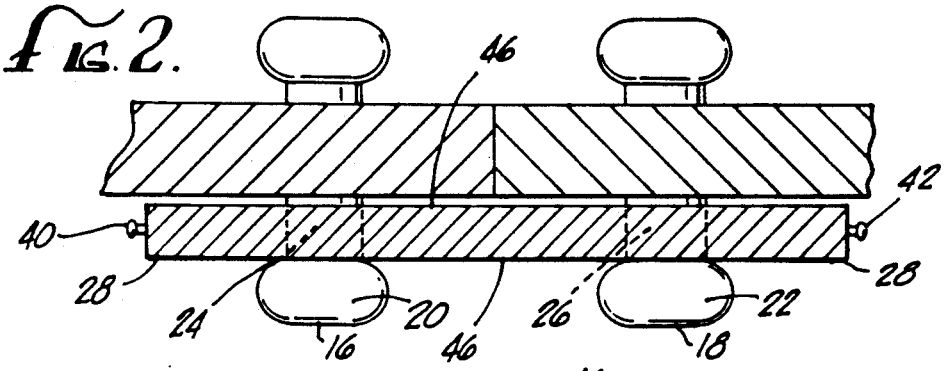
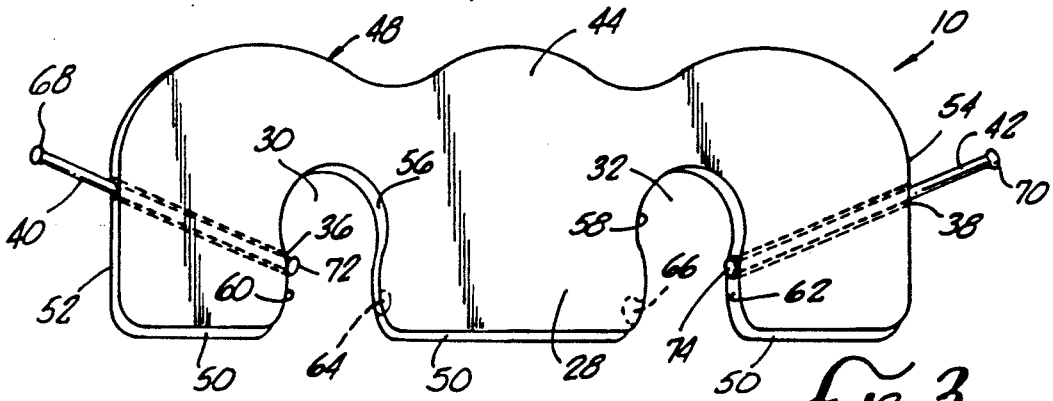
FIG. 3.
FIG. 4.
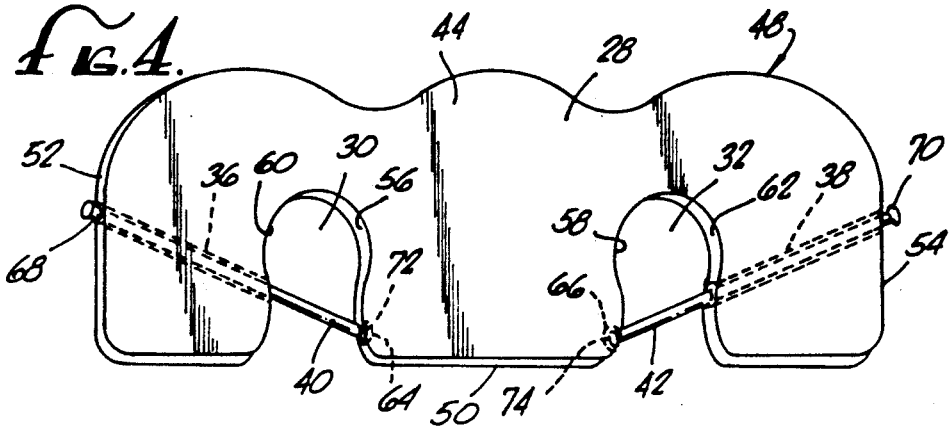

SECURITY DEVICE FOR DUAL DOORS

BACKGROUND

The present invention relates to security devices for dual adjacent doors.

Homes and other buildings are frequently equipped with doorways designed for dual adjacent doors which swing from hinges on opposite sides of the doorway. The dual doors typically have door handles or knobs which are adjacent near the inside edges of the dual doors.

Dual doors improve accessibility to the building and enhance the outward aesthetic appearance of the building. However, dual doors also present higher security risks than single doors.

A variety of security devices exist for locking dual doors for security purposes. Typically, such devices are fairly expensive to manufacture, require a number of parts and have strict tolerance requirements. Furthermore, locking devices are often subject to mechanical breakdown and frequently must be bolted into place on or near the doors.

For the foregoing reasons, there is a need for a security device for dual doors which is:

(1) inexpensive to manufacture;

(2) does not require parts which must meet strict tolerance requirements;

(3) can be secured to dual doors in an effective manner;

(4) is easy to install and remove;

(5) does not need to be bolted into place;

(6) is lightweight and easy to store; and (7) is portable.

SUMMARY

The present invention is directed to a security device for dual doors that satisfies the foregoing needs.

A security device according to the present invention can secure dual adjacent doors, each having a door knob with a neck portion and a head portion. A security device having features of the present invention comprises a rigid plate, two openings spaced apart from one another in the bottom wall of the plate, two holes in opposing side walls of the plate extending through the plate into the openings, and locking pins slidably disposed in the holes.

The openings are wider than the neck portions and narrower than the head portions of the door knobs so that the neck portions fit within the openings and the plate is held in place by the head portions when the plate is installed on the doors.

In their locking positions, the locking pins can extend through the holes and into the openings below the neck portions of the door knobs so that the pins prevent the plate from being removed from the doors when the plate is installed on the doors. The pins have portions which protrude out of the holes near the side walls for gripping by a user of the security device to make it easier to slide the pins into and out of their locking positions.

The locking pins can slant downwardly from the side walls toward the openings and extend across the openings into notches within the inside walls of the openings when the pins are in the locking positions. This helps secure the pins to prevent the security device from being removed from the doors.

The locking pins can also have means for preventing removal of the pins from the security device such as a ball integral with inside ends of the pins that has a diameter larger than the hole in which the pin slides. This prevents the pins from being separated from the security device and lost during storage or use.

DRAWINGS

These and other features, aspects, and advantages of the present invention will become understood with regard to the following description, appended claims and accompanying drawings where:

FIG. 1 shows a security device having features of the present invention in its locking position and installed on dual adjacent doors having door knobs;

FIG. 2 is a cross-sectional view of the security device of FIG. 1 along line AA of FIG. 1;

FIG. 3 shows a second security device having features of the present invention having locking pins in unlocked positions; and FIG. 4 shows the security device of FIG. 3 having locking pins in positions.

DESCRIPTION

As shown in FIGS. 1 through 4, a security device 10 for securing adjacent doors 12 and 14 having first and second door knobs 16 and 18 is disclosed. The door knobs 16 and 18 comprise first and second head portions 20 and 22 and first and second neck portions 24 and 26, respectively.

The security device 10 comprises a rigid plate 28, first and second openings 30 and 32, first and second holes 36 and 38, and first and second locking pins 40 and 42.

The rigid plate 28 is made of a substantially inflexible, durable material such as wood, hard plastic or metal. The plate 28 is typically stamped or molded into a solid block of material.

Door knobs on dual doors can be about four to ten inches apart. A convenient lateral length of a plate 28 for such dual doors typically ranges between about seven and fourteen inches, depending primarily on the spacing and sizing of the door knobs. A convenient vertical width of the plate would typically be between about three and eight inches, depending on the sizes of the door knobs. A suitable thickness for the plate 28 convenient for most neck portions and head portions of typical door knobs would be about one-half inch to about one inch, depending on the thickness of the neck portions. All of the foregoing dimensions could be easily varied to fit varying spacings and sizings of doors and door knobs.

The plate has a front face 44 and a rear face 46, a top wall 48, a bottom wall 50, and first and second side walls 52 and 54. The plate 28 is disposed between two parallel planes defined by the front and rear faces 46 and 48.

The first and second openings 30 and 32 are spaced apart from one another in the bottom wall 50 of the plate 28. The holes 36 and 38 extend substantially parallel to and between the two planes defined by the front and rear faces 44 and 46 of the plate 28. The first and second holes 36 and 38 are in the first and second walls 52 and 54, respectively. The top wall 48 can be of varying shapes for ornamental purposes, as is illustrated in the contrasting shapes of the top wall 48 for the different embodiments of the present invention illustrated in FIGS. 1 and 3.

The first and second openings 30 and 32 each have first and second inside walls 56 and 58, respectively, and first and second outside walls 60 and 62, respectively. The inside walls 56 and 58 and the outside walls 60 and 62 are contiguous with the bottom wall 50 of the plate 28.

The first and second openings 28 and 30 are wider than the first and second neck portions 24 and 26, respectively, so that the first and second neck portions 24 and 26 fit within the first and second openings 30 and 32, respectively. This allows the plate 28 to slip over the door knobs 16 and 18 for installation of the security device 10 on the doors 12 and 14.

The first and second openings 30 and 32 are narrower than the first and second head portions 20 and 22, respectively. As a result, the plate 28 is held in place by the head portions 20 and 22 when the plate is installed on the doors 12 and 14. The sizes of the openings 30 and 32 prevent the security device 10 from slipping off the neck portions 24 and 26 on which the security device rests because the first and second head portions 20 and 22 have diameters which are wider than the widths of the first and second openings 30 and 32.

The dimensions of the openings 30 and 32 are governed by the spacing between the door knobs 16 and 18 and the thickness of the neck portions 24 and 26. The distances between the centers of the first and second openings 30 and 32 typically ranges from about four inches to about ten inches. The width of each of the neck portions 24 and 26 are usually the same, typically from about three quarters of an inch to two inches. The widths of the first and second openings 30 and 32 would preferably be slightly larger than the widths of the respective neck portions.

The first and second holes 36 and 38 extend through the plate 28 and the first and second outside walls 60 and 62, respectively, so that the first and second locking pins 40 and 42 can slide into the openings 30 and 32, respectively.

First and second notches 64 and 66 can be provided in the first and second inside walls 56 and 58, respectively, of the openings 30 and 32. The first and second notches 64 and 66 receive the first and second locking pins 40 and 42, respectively, to help prevent the security device 10 from slipping off of the door knobs 16 and 18.

The first and second locking pins 40 and 42 are slidably disposed within the first and second holes 36 and 38. The first and second locking pins 40 and 42 have diameters less than diameters of the first and second holes 36 and 38 so that the pins 40 and 42 slide in the holes 36 and 38. The locking pins 40 and 42 have unlocked positions as illustrated in FIG. 3 and locked positions as illustrated in FIGS. 1 and 4.

The first and second locking pins 40 and 42 are sufficiently long so that they are capable of extending through the first and second holes 36 and 38, respectively, into the first and second openings 30 and 32, respectively, and below the first and second neck portions 24 and 26, respectively, when the plate 28 is installed, as illustrated in FIG. 1. In their locked positions, the locking pins 40 and 42 thereby prevent the plate from being removed from the doors 12 and 14.

The locking pins 40 and 42 have protruding portions 68 and 70, respectively, extending out of the holes 36 and 38, respectively, for gripping by a user of the security device 10. The locking pins 40 and 42 can contact the inside walls 56 and 58, respectively, when the pins 40 and 42 are extended into the openings 30 and 32, respectively.

The first and second holes 36 and 38 can slant downwardly from the first and second side walls, respectively, toward the openings 30 and 32, respectively, when the plate is installed on the doors. The holes 36 and 38 can alternatively be disposed laterally with respect to the plate 28; however, a downward slant is preferable because the pins 40 and 42 are then biased toward their locked positions thereby allowing for a gravity feed of the pins 40 and 42 when the device 10 is installed on the doors 12 and 14.

Each of the locking pins 40 and 42 can have means for preventing removal of the locking pin from the respective holes 36 or 38, such as the first and second balls 72 and 74 on the ends of the first and second locking pins 40 and 42, respectively. The first and second balls 72 and 74 have diameters larger than the diameters of the first and second holes 36 and 38, respectively, thereby preventing the entire length of the locking pins 40 and 42 from being pulled out past the first and second outside walls 60 and 62, respectively, of the openings 30 and 32. The balls 72 and 74 also fit within the notches 64 and 66, respectively, and rest therein when the first and second locking pins 40 and 42, respectively, are in their locked positions.

The locking pins 40 and 42 can have gripping balls 76 and 78 on the protruding portions 68 and 70, respectively, for gripping the pins to make it easier to slip the pins into and out of their locking positions.

Use of the security device 10 is simple and easy. The first and second locking pins 40 and 42 are first slid into their unlocked positions. The security device 10 is then placed against the doors 12 and 14 above the door knobs 16 and 18 in the orientation illustrated in FIG. 3 of the drawings. The security device 10 is then slid over the narrow portions 24 and 26 of the door knobs 16 and 18. If the openings 30 and 32 of the device 10 are placed appropriately just above the neck portions 24 and 26, the device can be allowed to drop into place on the doors 12 and 14 thereby providing a gravity feed of the device 10. The locking pins 40 and 42 are then slid into their locked positions and the security device 10 is installed.

The security device 10 is as easy to remove as it is to install and use. The locking pins 40 and 42 are moved to their unlocked positions and the security device 10 is slipped upwardly away from the door knobs 12 and 14 and pulled away from the doors 12 and 14.

The security device 10 has many other advantages. It is very easy and inexpensive to manufacture. The plate 28 is stamped or molded in substantially the shape illustrated in the drawings to a suitable size to fit the spacings of the door knobs to be secured. The holes 36 and 38, and optionally the notches 64 and 66, are drilled or otherwise formed in substantially the locations indicated in the drawings. The locking pins 40 and 42 without the balls 72 and 74 are slid into the holes 36 and 38. Finally, the balls 72 and 74 are soldered, welded or otherwise attached to lower ends of the locking pins 40 and 42 with the locking pins extending into the openings 30 and 32.

In addition, the security device 10 has only three separate parts, the plate 28 and the first and second locking pins 40 and 42. This reduces manufacturing cost and the likelihood of lost or broken parts.

The manufacturing specifications and tolerances need not be precise for the security device 10. The size of the openings 30 and 32, the holes 36 and 38 and the locking pins 40 and 42 can vary within lenient tolerances. Even the shapes of the foregoing elements need not be precise. The openings 30 and 32 need only be wide enough to slip over the narrow portions 24 and 26 and narrow enough so that the openings 30 and 32 do not slip over the head portions 20 and 22 of the door knobs 16 and 18. Preferably, the openings 30 and 32 fit over the narrow portions 24 and 26 snugly so that the security device 10 does not move substantially in a lateral direction on the doors. The most important dimension of the openings 30 and 32 is the placement of the first and second outside walls 60 and 62 of the openings 30 and 32 at outer edges of the first and second narrow portions 24 and 26 of the door knobs 16 and 18. This is because When the doors 12 and 14 are opened the knobs will move farther apart and the security device 10 is designed to prevent this from happening. However, small variations in dimensions will not cause the security device 10 to be ineffective.

The locking pins 40 and 42 and the holes 36 and 38 have circular cross-sections but need not be precisely circular in cross-section as long as the pins 40 and 42 can slide in the holes 36 and 38 and fit into the notches 64 and 66.

The security device 10 does not need to be bolted into place but is instead held in place by the existing apparatus of the door. The device 10 is also lightweight and portable and is therefore easy to store for later use.

The security device 10 secures the adjacent doors 12 and 14 in an effective manner and can be used alone or in conjunction with other security devices, such as dead bolts. The locking pins 40 and 42 prevent the security device 10 from being removed by slipping a thin shaft or other device through the doors and flipping the security device 10 upwards. The security device 10 is also designed not to be removed by a device that slips between the doors and grips the device to move it laterally.

Finally, the security device 10 can be ready for use without being stalled on the doors 12 and 14 by attaching the device 10 to only one of the door knobs 16 or 18 at one of the openings 30 or 32. The device 10 is thereby allowed to hang freely from a single door knob 16 or 18.

Although the present invention has been described in considerable detail with reference to certain preferred versions thereof, other versions are possible. Therefore, the spirit and scope of the appended claims should not be limited to the description of the preferred versions contained herein.

What is claimed is:

1. A security device for securing first and second adjacent doors having first and second door knobs, respectively, each door knob having a neck portion and a head portion, the security device comprising:

(a) a rigid plate disposed substantially between two parallel planes, the rigid plate having a bottom wall, a first side wall and a second side wall;

(b) first and second openings spaced apart from one another in the bottom wall of the plate, the first and second openings having first and second inside walls and first and second outside walls, respectively, contiguous with the bottom wall, the first and second openings being wider than the neck portions and narrower than the head portions of the first and second door knobs, respectively, so that the neck portions fit within the openings and the plate is held in place by the head portions when the plate is installed on the doors;

(c) first and second holes in the first and second side walls, respectively, the first and second holes extending substantially parallel to and between the two planes through the plate and through the first and second outside walls, respectively; and (d) first and second locking pins slidably disposed within the first and second holes, respectively, the pins being sufficiently long so that, in locked positions of the pins, the first and second pins are capable of extending:

(i) through the first and second holes, respectively;

(ii) into the first and second openings, respectively; and (iii) below the first and second neck portions, respectively, when the plate is installed, so that, in their locked positions, the pins prevent the plate from being removed from the doors when the plate is installed on the doors, the first and second pins further having protruding portions extending out of the holes for gripping by a user of the security device.

2. The security device of claim 1 wherein the first and second holes slant downwardly from the first and second side walls respectively, toward the first and second openings, respectively, when the plate is installed on the doors.

3. The security device of claim 1 wherein the first and second locking pins contact the first and second inside walls respectively, when the pins are extended in the first and second openings, respectively.

4. The security device of claim 1 wherein each locking pin further includes means for preventing removal of the pin from its respective hole.

5. The security device of claim 4 wherein the means for preventing removal comprises a ball integral with an inside end of the respective pin, each ball having a diameter larger than a diameter of the respective hole in which the respective pin slides.

6. The security device of claim 5 wherein each inside wall has a notch, each ball resting in its respective notch when the respective pin is in its locked position.

7. The security device of claim 1 wherein each protruding portion has a gripping ball for gripping to make it easier to slide the respective pin in the respective hole.

8. A security device for securing first and second adjacent doors having first and second door knobs, respectively, each door knob having a neck portion and a head portion, the security device comprising:

(a) a rigid plate disposed substantially between two parallel planes, the rigid plate having a bottom wall, a first side wall and a second side wall;

(b) first and second openings spaced apart from one another in the bottom wall of the plate, the first and second openings having first and second inside walls and first and second outside walls, respectively, contiguous with the bottom wall, the first and second openings being wider than the neck portions and narrower than the head portions of the first and second door knobs, respectively, so that the neck portions fit within the openings and the plate is held in place by the head portions when the plate is installed on the doors;

(c) first and second holes in the first and second side walls, respectively, the first and second holes extending substantially parallel to and between the two planes and slanting downwardly from the first and second outside walls, respectively, toward the first and second openings, respectively, when the plate is installed on the doors, the first and second holes extending through the plate and through the first and second outside walls, respectively; and (d) first and second locking pins slidably disposed within the first and second holes, respectively, the pins being sufficiently long so that, in locked positions of the pins, the first and second pins are capable of extending:

(i) through the first and second holes, respectively;

(ii) inside the first and second openings, respectively; and (iii) below the first and second neck portions, respectively, when the plate is installed, so that, in their locked positions, the pins prevent the plate from being removed from the doors when the plate is installed on the doors, the first and second pins further having means for preventing removal of the pins from the holes and protruding portions extending out of the holes for gripping by a user of the security device.

9. The security device of claim 8 wherein each protruding portion has a gripping ball for gripping the respective pin to make it easier to slide the respective pin in the respective hole.

10. The security device of claim 8 wherein the means for preventing removal comprises a ball integral with an inside end of the respective pin, each ball having a diameter larger than a diameter of the respective hole in which the respective pin slides.

11. The security device of claim 10 wherein each inside wall has a notch, each ball resting in its respective notch when the respective pin is in its locked position.

12. A security device for securing first and second adjacent doors having first and second door knobs, respectively, each door knob having a neck portion and a head portion, the security device comprising:

(a) a rigid plate disposed substantially between two parallel planes, the rigid plate having a bottom wall, a first side wall and a second side wall;

(b) first and second openings spaced apart from one another in the bottom wall of the plate, the first and second openings having first and second inside walls and first and second outside walls, respectively, contiguous with the bottom wall, the first and second openings being wider than the neck portions and narrower than the head portions of the first and second door knobs, respectively, so that the neck portions fit within the openings and the plate is held in place by the head portions when the plate is installed on the doors;

(c) first and second holes in the first and second side walls, respectively, the first and second holes extending substantially parallel to and between the two planes and slanting downwardly from the first and second side walls, respectively, toward the first and second openings, respectively, when the plate is installed on the doors, the first and second holes extending through the plate and through the first and second outside walls, respectively; and (d) first and second locking pins slidably disposed within the first and second holes, respectively, the pins being sufficiently long so that, in locked positions of the pins, the first and second pins are capable of extending:

(i) through the first and second holes, respectively;

(ii) inside the first and second openings respectively; and (iii) below the first and second neck portions respectively, when the plate is installed, so that, in their locked positions, the pins prevent the plate from being removed from the doors when the plate is installed on the doors, the first and second pins each having means for preventing removal of the pins from the holes and protruding portions extending out of the holes for gripping by a user of the security device; and (e) first and second notches in the first and second inside walls, respectively, each means for preventing removal resting in its respective notch when the respective pin is in its locked position.

13. The security device of claim 12 wherein the means for preventing removal comprises a ball integral with an inside end of the respective pin, the ball having a diameter larger than a diameter of the respective hole in which the respective pin slides.

14. The security device of claim 12 wherein each protruding portion has a gripping ball for gripping to make it easier to slide the respective pin in the respective hole.

* * * * *